US007244049B2

(12) United States Patent
Suzuki

(10) Patent No.: US 7,244,049 B2
(45) Date of Patent: Jul. 17, 2007

(54) LIGHT ASSEMBLY FOR VEHICLE

(75) Inventor: Eiji Suzuki, Zama (JP)

(73) Assignee: Ichikoh Industries, Ltd. (JP)

( * ) Notice: Subject to any disclaimer, the term of this patent is extended or adjusted under 35 U.S.C. 154(b) by 99 days.

(21) Appl. No.: 11/175,228

(22) Filed: Jul. 6, 2005

(65) Prior Publication Data

US 2006/0007544 A1 Jan. 12, 2006

(30) Foreign Application Priority Data

Jul. 6, 2004 (JP) ..... P2004-199656

(51) Int. Cl.
*F21V 9/00* (2006.01)

(52) U.S. Cl. ..... 362/293; 362/297; 362/347

(58) Field of Classification Search ..... 362/293–294, 362/297, 346
See application file for complete search history.

(56) References Cited

U.S. PATENT DOCUMENTS 3,711,700 A 1/1973 Westlund, Jr. et al.
5,321,586 A * 6/1994 Hege et al. ..... 362/554
6,382,824 B1 * 5/2002 Prasad et al. ..... 362/551
6,644,840 B2 * 11/2003 Yagi et al. ..... 362/510
2003/0090906 A1 5/2003 Hayakawa

FOREIGN PATENT DOCUMENTS

| | | |
|---|---|---|
| DE | 196 30 935 A1 | 10/1997 |
| EP | 0 460 913 A | 12/1991 |
| GB | 2 311 593 A | 10/1997 |
| JP | 2003-19919 | 1/2003 |

* cited by examiner

*Primary Examiner*—Thomas M. Sember
*Assistant Examiner*—Julie A. Shallenberger
(74) *Attorney, Agent, or Firm*—Kilpatrick Stockton LLP

(57) ABSTRACT

A light assembly for a vehicle is provided with a light source capable of emitting rays including a visible ray and an infrared ray, a main reflector disposed so as to reflect the rays emitted by the light source forward, and a filter being reflective of the infrared ray and transparent to the visible ray.

6 Claims, 6 Drawing Sheets

LIGHT ASSEMBLY FOR VEHICLE

BACKGROUND OF THE INVENTION

1. Field of the Invention

The present invention relates to a light assembly for a vehicle, which is capable of simultaneously and independently projecting an infrared ray and a visible ray.

2. Description of the Related Art

An infrared light assembly is in general provided with a light bulb, a reflector and an infrared filter. The infrared filter is typically provided with an infrared filtering layer coated on a transparent plate, for example made of glass, thereby the infrared filter is transparent to infrared rays and opaque to visible rays. Though the light bulb is capable of emitting light including both a visible ray and an infrared ray, only the infrared ray can penetrate the infrared filter. Thereby the infrared light assembly can exclusively emit the infrared ray. For visually checking whether the light bulb is on or off or any other purpose, the transparent plate may be partly free from the infrared filtering layer so as to slightly transmit the visible ray.

SUMMARY OF THE INVENTION

In accordance with the above-described infrared light assembly, a great part of the visible ray is wasted and hence cannot be effectively used.

The present invention is intended for providing a light assembly for a vehicle, which is capable of simultaneously and independently projecting an infrared ray and a visible ray.

According to an aspect of the present invention, a light assembly for a vehicle is provided with: a light source capable of emitting rays including a visible ray and an infrared ray; a main reflector disposed so as to reflect the rays emitted by the light source forward; and a filter being reflective of the infrared ray and transparent to the visible ray.

Preferably, the light assembly is further provided with a sub reflector disposed so as to reflect the infrared ray reflected by the filter forward. Alternatively preferably, the filter is disposed so as to reflect the infrared ray forward.

More preferably, the light assembly is further provided with a lamp housing disposed in front of the main reflector and the light source, the lamp housing including a side aperture at a side of the lamp housing and the filter is disposed so as to reflect the infrared ray toward the side aperture and the sub reflector is disposed so as to be exposed to the side aperture.

Still preferably, the main reflector has a reflecting surface having a first focal point and a second focal point, the light source is disposed around the first focal point and the filter is disposed between the light source and the second focal point. Further preferably, the sub reflector includes a sub reflecting surface formed in a shape selected from the group of a paraboloidal surface and a free curved surface based on a paraboloidal surface. More preferably, the sub reflector is disposed so that a focal point defined by the sub reflecting surface is symmetrical to the second focal point of the main reflector with respect to a reflecting surface of the filter.

DETAILED DESCRIPTION OF THE PREFERRED EMBODIMENT

A phrase "free curved surface" is defined and used as any curved surface obtained by deforming a basic surface under a particular computational method. Details of the method are defined in U.S. Pat. No. 6,811,289, which is incorporated herein by reference.

Terms "paraboloidal" and "ellipsoidal" respectively mean "of paraboloid of revolution" and "of ellipsoid of revolution".

Certain embodiments of the present invention will be described hereinafter with reference to accompanying drawings. Throughout the specification and claims, positions and directions such as "front", "forward", "rear" and "rearward" are defined with respect to a light axis of a light assembly and a direction where a light emitted out of the light assembly progresses. For example, a front is drawn in the left of FIG. 1 and a rear is opposed thereto.

Figure 1:
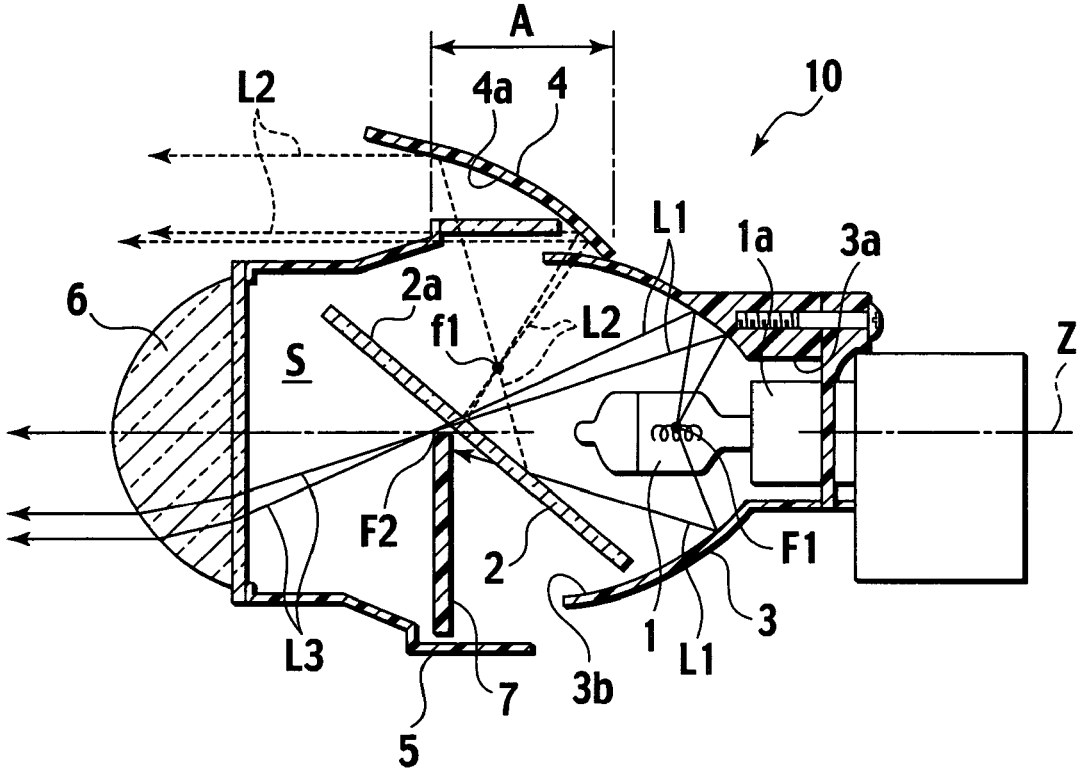
FIG. 1 is a cross sectional view of a light assembly according to a first embodiment of the present invention.

Reference is now made to FIG. 1. A light assembly 10 for a vehicle in accordance with a first embodiment of the present invention is generally provided with a light source 1 disposed in a light cavity S, a filter 2, a main reflector 3 and a sub reflector 4. The light source 1 is capable of emitting light including both visible rays and infrared rays. The main reflector 3 reflects rays L1 emitted by the light source 1 forward and the filter 2 reflects the infrared rays L2 and filters the visible rays L3. The sub reflector 4 reflects the infrared rays L2 reflected by the filter 2 forward. In FIG. 1, the emitted rays L1 and the visible rays L3 are drawn in solid lines and the infrared rays L2 are drawn in broken lines.

The light source 1 is installed in a socket portion 1*a*, which is installed in a bulb insertion opening 3*a* formed at a rear end of the main reflector 3. A halogen bulb can be preferably applied to the light source 1. The main reflector 3 has a substantially ellipsoidal reflecting surface 3*b* as an inner surface thereof and an aperture at a front end thereof. A substantially cylindrical holder 5 is installed at the aperture of the main reflector 3. A convex lens 6 is installed at a front aperture of the holder 5. The light cavity S is defined by the main reflector 3, the holder 5 and the convex lens 6. The main reflector 3 and the holder 5 also constitute a lamp housing.

Because the reflecting surface 3*a* of the main reflector 3 is formed in a substantially ellipsoidal shape, a pair of focal points are defined. One of the focal points existing near the bottom of the reflecting surface 3*a* is referred to as a first focal point F1 and the other far from the bottom is referred to as a second focal point F2.

The filter 2 consists of a dielectric multilayer mirror, which is configured to be transparent to rays having visible spectra and reflect rays having infrared spectra. Such a dielectric multilayer mirror is commercially available in a trade name of "03MHG hot-mirror-coating" (MELLES GRIOT K.K.).

The main reflector 3 and the holder 5 leave a side aperture A at an upper side thereof. The filter 2 is disposed obliquely to an optical axis Z so as to reflect the infrared rays L2 substantially perpendicularly to the optical axis Z. The sub reflector 4 has a reflecting surface 4*a*, which is exposed to the side aperture A. The reflecting surface 4*a* reflects the infrared rays L2 forward, substantially parallel to the axis Z. More specifically, the filter 2, the side aperture A and the sub reflector 4 are so dimensioned that the infrared rays L2 are reflected and pass through the side aperture A to the sub reflector 4 and further reflected forward. A size of the filter 2 is not necessary to be enough to partition the light cavity S but appropriately determined to gain an enough amount of luminous flux of the infrared rays L2.

By using the light assembly 10, the rays L1 emitted by the light source 1 directly or after being reflected by the main reflector 3 reach the filter 2 and are separated into the infrared rays L2 and the visible rays L3 by the filter 2.

More specifically, the infrared rays L2 change optical paths by the filter 2, however, the visible rays L3 penetrate the filter 2 substantially without changing paths. Then, if the infrared rays L2 in small part are not reflected by and penetrate the filter 2, the rays emitted out of the lens 6 are not influenced by the leaking infrared rays in view of a light pattern or a color.

The visible rays L3 can be regulated by the main reflector 3 and the lens 6 in a preferable light pattern.

The infrared rays L2 are emitted via the sub reflector 4 to a direction, which can be regulated independently of a direction of the visible rays L3.

More specifically, the rays L1 emitted by the light source 1 directly or after being reflected by the main reflector 3 reach the filter 2 and the infrared rays L2 separated therefrom by the filter 2 are emitted out of the side aperture A. The visible rays L3 separated by the filter 2 therefrom penetrate the filter 2 to the convex lens 6 and are further emitted forward with respect to the light assembly 10. The infrared rays L2 are further reflected by the sub reflector 4 and are emitted forward with respect to the light assembly 10.

The light assembly 10 is further provided with a shade 7 fixed to the holder 5 and interposed between the lens 6 and the filter 2. The shade 7 accomplishes a low beam pattern with respect to the visible rays L3, which is necessary for a light assembly for a vehicle. A top of the shade 7 is disposed around one of the focal points, namely a second focal point F2, of the main reflector 3 and below the filter 2.

The light assembly 10 can be used in place of a light commonly applied to a vehicle and further has a function of emitting infrared rays independently of usual functions as the common light. Moreover, the light assembly 10 may use a colorless lens and can effectively use the emitted light without greatly wasting.

Moreover, since the sub reflector 4 is disposed at a side of the light assembly 10, a length thereof along the light axis Z may not be elongated as compared with the commonly applied light. More specifically, the light assembly 10 can be constituted in a compact body without any omission of the multi-functions.

Preferably, the light source 1 is disposed around a first focal point F1 of the main reflector 3, the filter 2 is interposed between the light source 1 and the second focal point F2 of the main reflector 3 and the sub reflector 4 has a reflecting surface 4*a* formed in a substantially paraboloidal shape or a free curved surface based on a paraboloidal shape.

In accordance with the present embodiment, the emitted rays L1 are efficiently condensed on a reflecting surface 2*a* of the filter 2. Thereby the infrared rays L2 are efficiently incident on the reflecting surface 4*a* of the sub reflector 4 through the side aperture A. And further, the luminous flux of the infrared rays L2 is assured to a sufficient amount, thereby the light assembly 10 can illuminate a subject with a sufficient brightness of the infrared rays L2.

More preferably, the sub reflector 4 is disposed so that a first focal point f1 defined by the reflecting surface 4*a* is substantially symmetrical to the second focal point F2 with respect to the reflecting surface 2*a*.

In accordance with the present embodiment, the infrared rays L2 reflected by the reflecting surface 2*a* focuses on the first focal point f1 and are then incident on the reflecting surface 4*a* of the sub reflector 4. Accordingly, the infrared rays L2 reflected by the reflecting surface 4*a* are emitted forward as substantially parallel rays.

Figure 2:
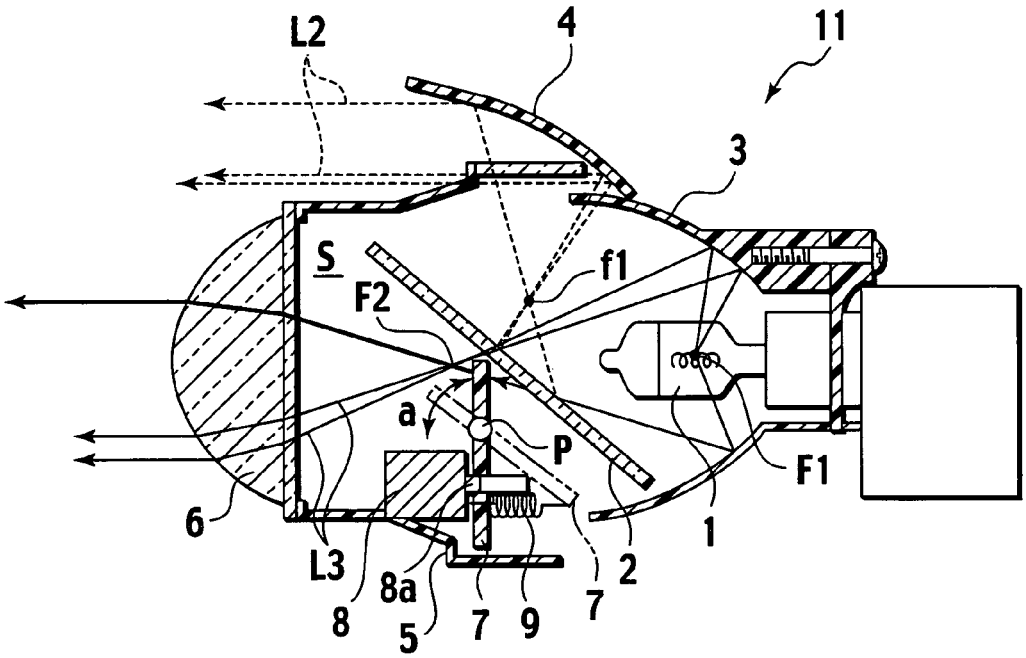
FIG. 2 is a cross sectional view of a light assembly according to a second embodiment of the present invention.

Reference is now made to FIG. 2. A light assembly 11 in accordance with a second embodiment of the present invention is constituted as a headlight for a vehicle. The light assembly 11 has the same constitution as one of the aforementioned light assembly 10 except for a movable shade 7.

The shade 7 is pivotally supported by the holder 5 and hence capable of swinging around a pivot P in directions drawn in an arrow a. The light assembly 11 is further provided with a drive mechanism 8 for driving the shade 7. Thereby the shade 7 is driven to swing between an upright position drawn in solid lines in FIG. 2 and an oblique position drawn in double-dashed lines.

The drive mechanism 8 is provided with a solenoid for driving a rod 8*a* and a return spring 9. The return spring 9 urges the shade 7 toward the upright position. On the contrary, when the solenoid drives the rod 8*a* to project, the rod 8*a* makes the shade 7 in the oblique position against the urging force of the return spring 9. The shade 7 in the upright position cuts off an upper half of the visible rays L3 and then the light assembly 11 emits the visible rays L3 in the low beam pattern. In contrast, the shade 7 in the oblique position allows all the visible rays L3 to pass and hence the light assembly 11 is in a high beam pattern.

As being understood, the light assembly 11 has a function for switching the low beam pattern and the high beam pattern.

Figure 3:
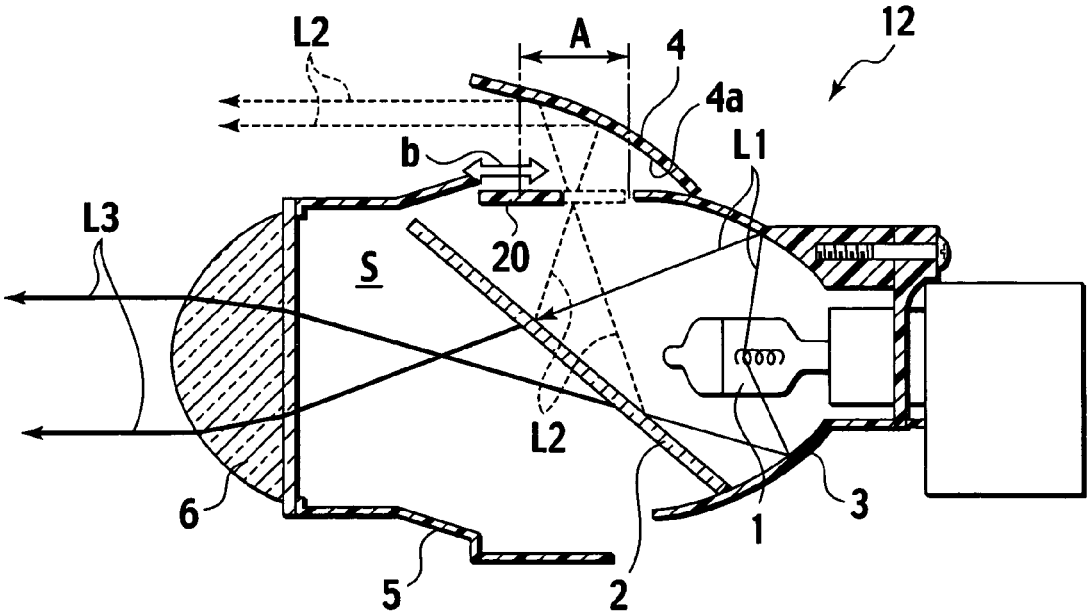
FIG. 3 is a cross sectional view of a light assembly according to a third embodiment of the present invention.

Reference is now made to FIG. 3. A light assembly 12 in accordance with a third embodiment of the present invention is constituted as a headlight for a vehicle. The light assembly 11 has substantially the same constitution as one of the aforementioned light assembly 10 except for providing a slidable shield 20 and omitting the shade 7. The shield 20 is configured to be slidable in directions b.

The shield 20 in a shut position cuts off the infrared rays L2 incident on the reflecting surface 4*a* the shield 20 in an open position allows the infrared rays L2 to pass therethrough and be hence emitted forward.

As being understood, the light assembly 12 has a function for switching the infrared rays L2 ON and OFF.

Figure 4:
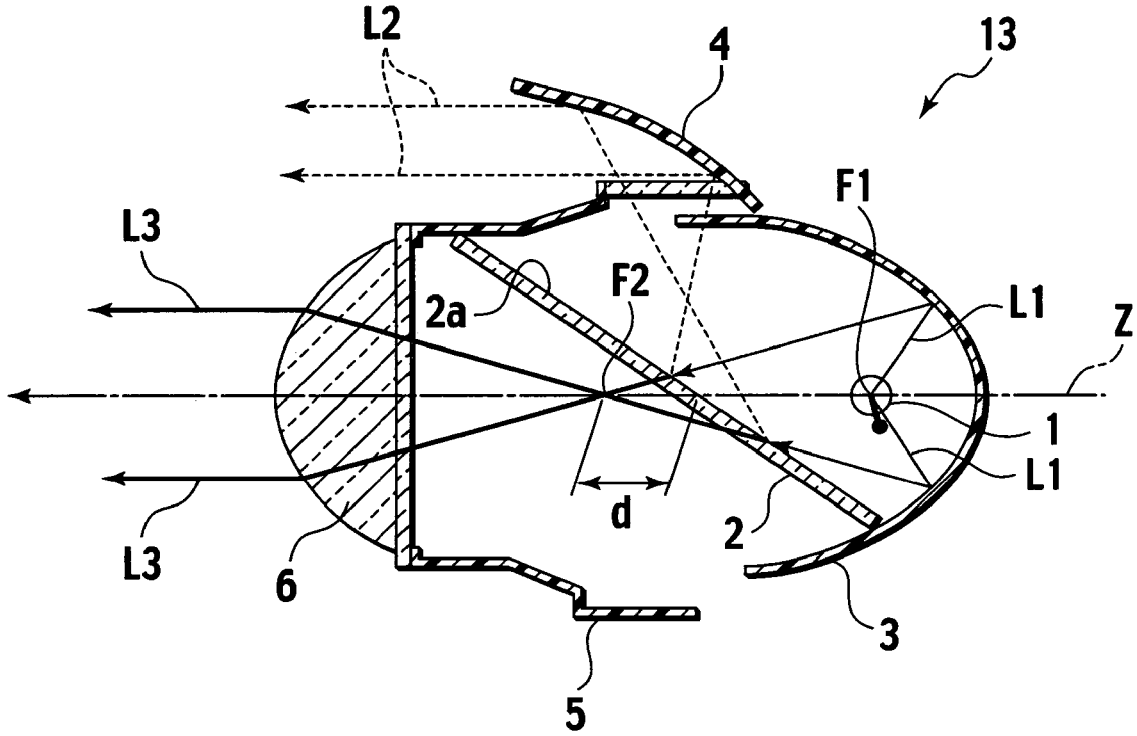
FIG. 4 is a cross sectional view of a light assembly according to a fourth embodiment of the present invention.

Reference is now made to FIG. 4. A light assembly 13 in accordance with a fourth embodiment of the present invention is constituted as a headlight for a vehicle. The light assembly 11 has a similar constitution to one of the aforementioned light assembly 10. According to the present embodiment, the main reflector 3 is modified and the shade 7 is omitted as compared with the light assembly 10.

The main reflector 3 is free from the bulb insertion opening 3*a* at the rear end of the light assembly 10. The light source 1 is installed laterally (or allowed to be oblique with respect to the light axis Z. According to this disposition, the filter 2 can be receded toward the main reflector 3 as compared with the aforementioned light assembly 10 and hence a distance d from the second focal point F2 to the reflecting surface 2*a* of the filter 2 along the axis Z is likely to be greater. This leads to an advantage in view of a thermal problem.

Moreover, the main reflector 3 can have a greater area for reflecting the emitted rays L1 since the bulb insertion opening 3*a* is omitted.

The light assembly 13 has a similar effect to the light assembly 10 and further has effects of heat resistance and efficiency of use of the emitted rays L1.

Figure 5:
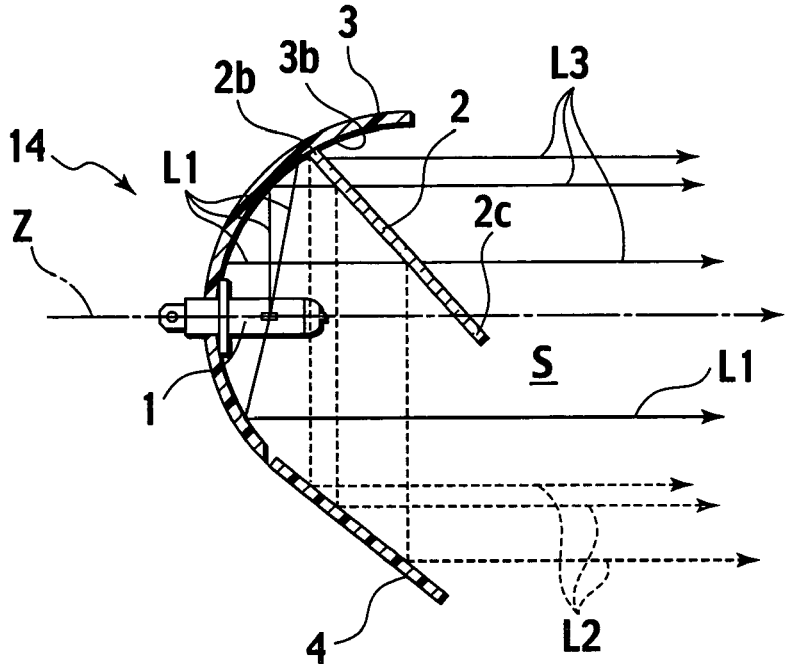
FIG. 5 is a cross sectional view of a light assembly according to a fifth embodiment of the present invention.

Reference is now made to FIG. 5. A light assembly 14 in accordance with a fifth embodiment of the present invention is constituted as a signal light for a vehicle. The light assembly 14 is provided with a light source 1 disposed in a light cavity S, a filter 2, a main reflector 3 and a sub reflector 4. The main reflector 3 reflects rays L1 emitted by the light source 1 forward and the filter 2 reflects the infrared rays L2 and filters the visible rays L3. The sub reflector 4 reflects the infrared rays L2 reflected by the filter 2 forward.

The main reflector 3 has a substantially paraboloidal reflecting surface 3*b* from which a lower portion thereof is removed. The light source 1 is installed at a rear end of the reflecting surface 3*b*. The filter 2 is formed in a plate-like shape and consists of a dielectric multilayer mirror like as the filter 2 of the first embodiment. The filter 2 is installed in a manner that an upper end 2*b* thereof is adjacent to an upper portion of the reflecting surface 3*b* and the whole is oblique in substantially 45 degree to the light axis Z.

The sub reflector 4 is also formed in a plate-like shape and installed at the removed lower portion of the reflecting surface 3*b*. The sub reflector 4 is substantially opposite to and parallel to the filter 2.

In accordance with the present embodiment, the rays L1 emitted by the light source 1 directly or after being reflected by the main reflector 3 reach the filter 2 and are separated into the infrared rays L2 and the visible rays L3 by the filter 2. In a range where the filter 2 covers, the filtered visible rays L3 are emitted forward, and in a range where the filter 2 does not cover, the emitted rays L1 are directly emitted forward.

The infrared rays L2 are reflected by the filter 2, further reflected by the sub reflector 4 and then emitted to a direction, which can be regulated independently of a direction of the visible rays L3.

Figure 6:
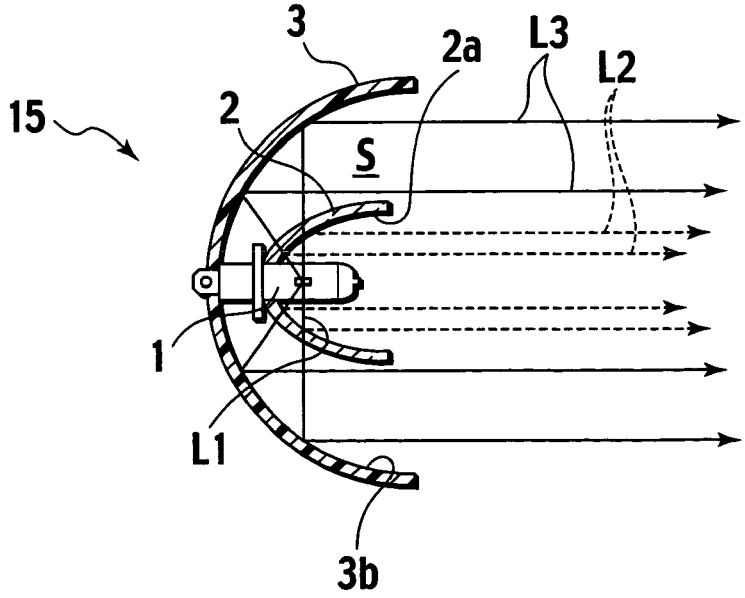
FIG. 6 is a cross sectional view of a light assembly according to a sixth embodiment of the present invention.

Reference is now made to FIG. 6. A light assembly 15 in accordance with a sixth embodiment of the present invention is constituted as a signal light for a vehicle. According to the present embodiment, the filter 2 reflects the infrared rays L2 forward.

The filter 2 is formed in a substantially paraboloidal shape, which is similar to but smaller than the main reflector 3, and installed within the main reflector 3, like as a coaxial disposition. The light source 1 is installed at the rear end thereof.

In accordance with the present embodiment, the rays L1 emitted by the light source 1 directly reach the filter 2 and are separated into the infrared rays L2 and the visible rays L3 by the filter 2. The infrared rays L2 are reflected forward by the filter 2. The visible rays L3 penetrate the filter 2 to reach the main reflector 3 and are then reflected forward. Thereby the infrared rays L2 and the visible rays L3 are emitted independently of each other. Normally, the infrared rays L2 are emitted coaxially with and at a center of the visible rays L3.

Figure 7:
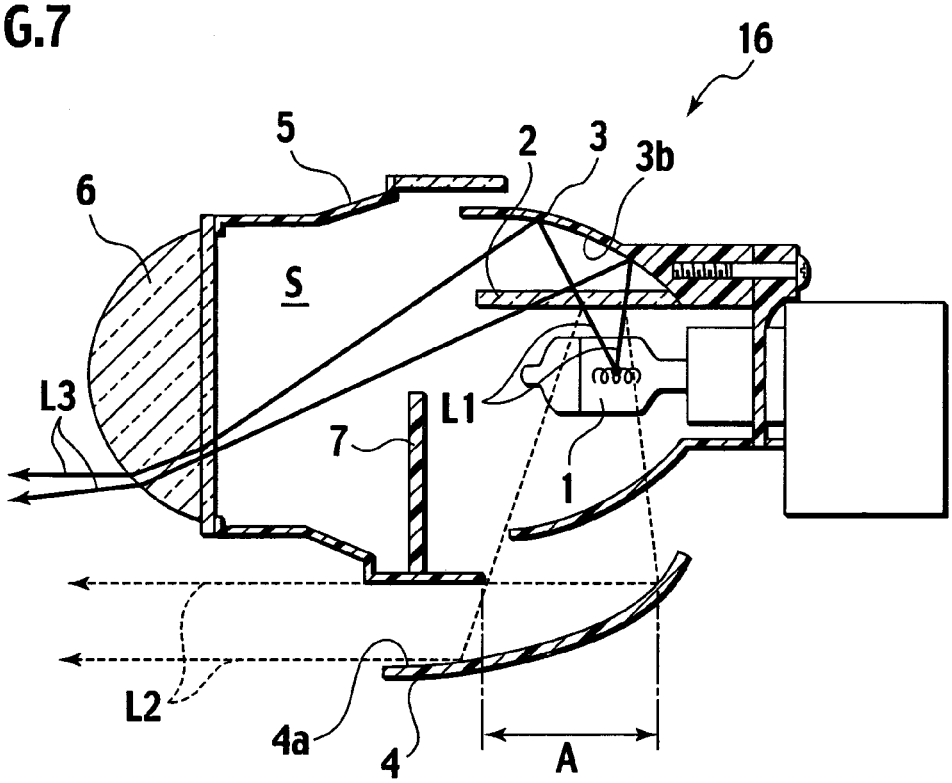
FIG. 7 is a cross sectional view of a light assembly according to a seventh embodiment of the present invention.

Reference is now made to FIG. 7. A light assembly 16 in accordance with a seventh embodiment of the present invention is constituted as a headlight for a vehicle. As compared to the aforementioned light assembly 10, the filter 2 is installed between the light source 1 and the main reflector 3 and disposed in parallel with the light source 1 and the light axis Z, and the side aperture A and the subreflector 4 are disposed oppositely to the filter 2. Except for them, the light assembly 16 has substantially the same constitution as one of the aforementioned light assembly 10.

Among the emitted rays L1, the rays traveling toward the filter 2 (upward as referred to FIG. 7) are separated into infrared rays L2 and visible rays L3 by the filter 2. The infrared rays L2 are reflected oppositely (downward as referred to FIG. 7) to pass through the aperture A and reach the sub reflector 4. The infrared rays L2 are further reflected forward by the sub reflector 4. The visible rays L3 penetrate the filter 2 to reach the main reflector 3 and are then reflected forward by the reflecting surface 3*b*.

The light assembly 16 can emit a low beam by using the rays L1 and L3 and further emit the infrared rays L2 toward a lower portion with respect to the visible ray beam.

Figure 8:
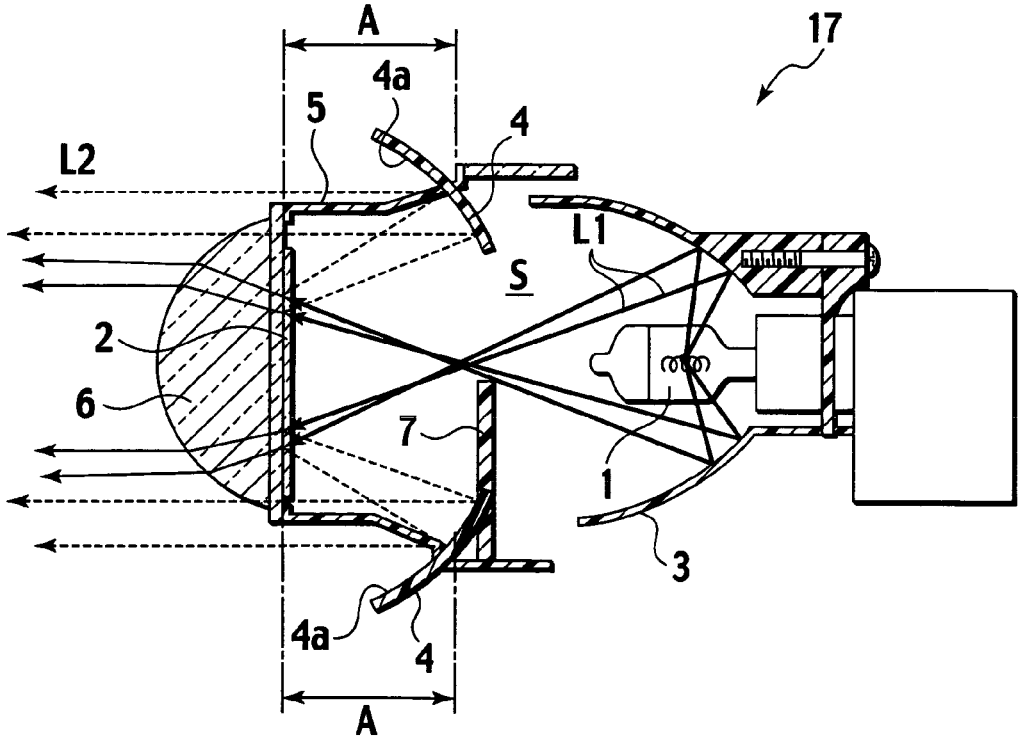
FIG. 8 is a cross sectional view of a light assembly according to an eighth embodiment of the present invention.

Reference is now made to FIG. 8. A light assembly 17 in accordance with an eighth embodiment of the present invention is constituted as a headlight for a vehicle. As compared to the aforementioned light assembly 10, the filter 2 is disposed adjacent and parallel to an inner surface of the convex lens 6 and a pair of side apertures A are provided at upper and lower sides of the holder 5. Moreover a pair of sub reflectors 4 are respectively provided in a way that respective reflecting surfaces 4*a* thereof are respectively exposed to the side apertures A. Except for them, the light assembly 17 has substantially the same constitution as one of the aforementioned light assembly 10.

In accordance with the present embodiment, the rays L1 emitted by the light source 1 directly or after being reflected by the main reflector 3 reach the filter 2 and are separated into infrared rays L2 and visible rays L3 by the filter 2. The infrared rays L2 are reflected and respectively pass through the side apertures A, and are respectively incident on the sub reflectors 4. The incident infrared rays L2 are respectively reflected forward by the sub reflectors 4. On the other hand, the visible rays L3 penetrate the filter 2 and the lens 6 to be emitted forward.

The light assembly 17 can emit a low beam by using the visible rays L3 and further emit the infrared rays L2 toward upper and lower portions with respect to the visible ray beam.

Figure 9:
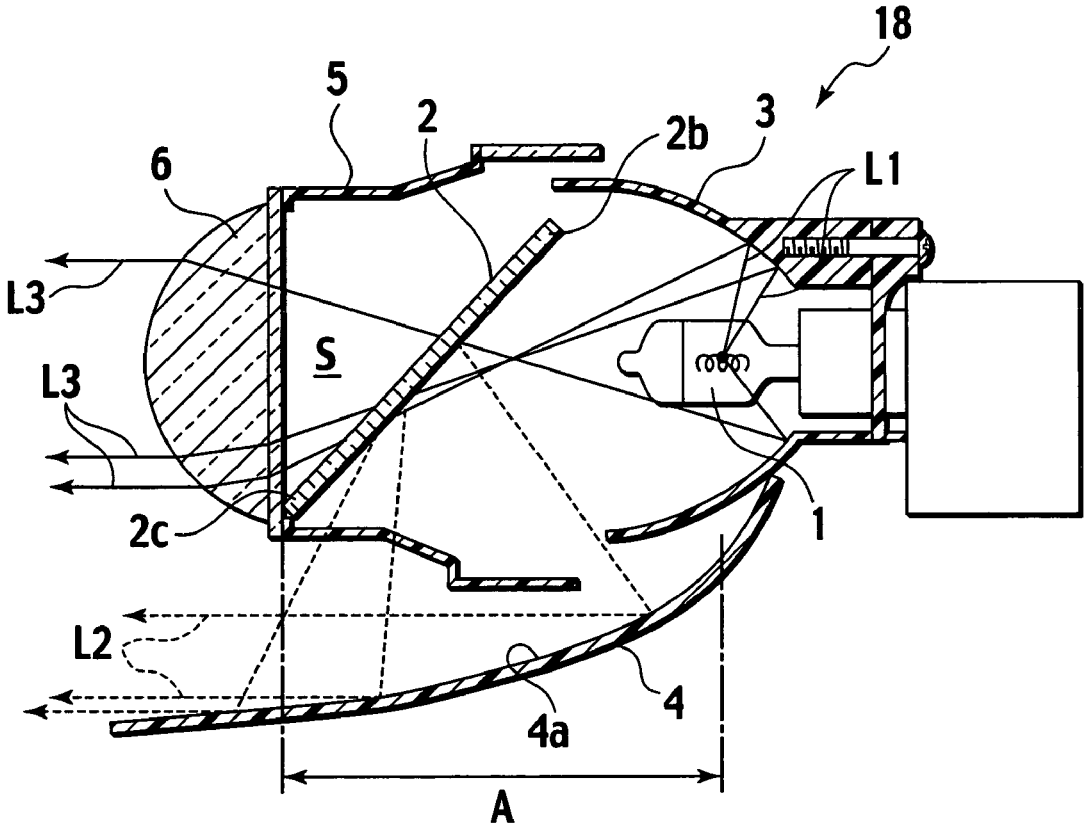
FIG. 9 is a cross sectional view of a light assembly according to a ninth embodiment of the present invention.

Reference is now made to FIG. 9. A light assembly 18 in accordance with a ninth embodiment of the present invention is constituted as a headlight for a vehicle. As compared to the aforementioned light assembly 10, obliqueness of the filter 2 is opposed to one of the first embodiment and the side aperture A is provided at the lower side of the holder 5. The shade 7 is omitted. Except for them, the light assembly 18 has substantially the same constitution as one of the aforementioned light assembly 10.

In accordance with the present embodiment, the rays L1 emitted by the light source 1 directly or after being reflected by the main reflector 3 reach the filter 2 and are separated into infrared rays L2 and visible rays L3 by the filter 2. The infrared rays L2 are reflected and pass through the side aperture A, and are incident on the subreflector 4. The incident infrared rays L2 are reflected forward by the sub reflector 4. On the other hand, the visible rays L3 penetrate the filter 2 and the lens 6 to be emitted forward.

The light assembly 18 can emit a high beam by using the visible rays L3 and further emit the infrared rays L2 toward a lower portion with respect to the visible ray beam.

Although the invention has been described above by reference to certain embodiments of the invention, the invention is not limited to the embodiments described above. Modifications and variations of the embodiments described above will occur to those skilled in the art, in light of the above teachings.

What is claimed is:

1. A light assembly for a vehicle comprising:

a light source capable of emitting rays including a visible ray and an infrared ray;

a main reflector disposed so as to reflect the rays emitted by the light source forward;

a filter being reflective of the infrared ray and transparent to the visible ray;

a sub reflector disposed so as to reflect the infrared ray reflected by the filter forward.

2. The light assembly of claim 1, wherein the filter is disposed so as to reflect the infrared ray forward.

3. The light assembly of claim 1, further comprising:

a lamp housing disposed in front of the main reflector and the light source, the lamp housing including a side aperture at a side of the lamp housing, wherein the filter is disposed so as to reflect the infrared ray toward the side aperture and the sub reflector is disposed so as to be exposed to the side aperture.

4. The light assembly of claim 3, wherein the main reflector includes a reflecting surface having a first focal point and a second focal point, the light source is disposed around the first focal point and the filter is disposed between the light source and the second focal point.

5. The light assembly of claim 4, wherein the sub reflector includes a sub reflecting surface formed in a shape selected from the group of a paraboloidal surface and a free curved surface based on a paraboloidal surface.

6. The light assembly of claim 5, wherein the sub reflector is disposed so that a focal point defined by the sub reflecting surface is symmetrical to the second focal point of the main reflector with respect to a reflecting surface of the filter.

* * * * *